US006350004B1

(12) United States Patent
Askren

(10) Patent No.: US 6,350,004 B1
(45) Date of Patent: Feb. 26, 2002

(54) METHOD AND SYSTEM FOR COMPENSATING FOR SKEW IN AN INK JET PRINTER

(75) Inventor: Benjamin A. Askren, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/124,104

(22) Filed: Jul. 29, 1998

(51) Int. Cl.[7] ..... B41J 29/38; B41J 2/165
(52) U.S. Cl. ..... 347/14; 347/23
(58) Field of Search ..... 347/40, 41, 12, 347/14, 15, 16, 19, 23, 10, 11, 43, 9, 47; 395/114

(56) References Cited

U.S. PATENT DOCUMENTS

| | | | | |
|---|---|---|---|---|
| 3,944,989 A | | 3/1976 | Yamada | |
| 4,272,771 A | | 6/1981 | Furukawa | |
| 4,638,329 A | | 1/1987 | Nakayama et al. | |
| 4,649,401 A | | 3/1987 | Kojima et al. | |
| 4,738,553 A | | 4/1988 | Uemura et al. | |
| 4,953,995 A | | 9/1990 | Sims et al. | |
| 5,193,008 A | | 3/1993 | Frazier et al. | |
| 5,288,156 A | | 2/1994 | Hori et al. | |
| 5,539,434 A | * | 7/1996 | Fuse | 347/40 |
| 5,627,572 A | | 5/1997 | Harrington, III et al. | |
| 5,658,471 A | | 8/1997 | Murthy et al. | |
| 5,661,510 A | | 8/1997 | Brandon et al. | |
| 5,684,516 A | | 11/1997 | Cseledy et al. | |
| 5,930,466 A | * | 7/1999 | Rademacher | 395/114 |
| 5,949,449 A | * | 9/1999 | Takashashi | 347/40 |
| 5,956,055 A | * | 9/1999 | Gibson et al. | 347/40 |

OTHER PUBLICATIONS

"A Theoretical and Experimental Examination of Thermal Ink Jet Nucleation Criteria", Robert Cornell, IS&T's NIP12: International Conference on Digital Printing Technologies, pp. 19–24.

"Development of a High Resolution Thermal Inkjet Printhead", Buskirk, et al., Hewlett–Packard Journal, pp. 55–61, Oct. 1988.

"A Theoretical and Experimental of the Bubble Jet Energy Window", Robert Cornell, IS&T's 47th Annual Conference/ICPS, pp. 587–590, 1984.

* cited by examiner

*Primary Examiner*—John Barlow
*Assistant Examiner*—Charles W. Stewart, Jr.
(74) *Attorney, Agent, or Firm*—Jacqueline M. Daspit; Ronald K. Aust

(57) ABSTRACT

A method and system for compensating for swath skew with respect to a perpendicular direction of carrier travel. An amount of swath skew is determined, and gross and/or fine skew adjustments are applied to reduce the swath skew to visually imperceptible limits. The method and system according to this invention can be carried out through software and/or hardware and thus eliminates the need for mechanical adjustment of an ink jet printer. The method and system operates by determining appropriate gross and fine skew adjustments upon insertion of a new printhead into a carrier. The fire order sequence of the fire groups in the printhead can be altered, and the swath data adjusted to compensate for swath skew caused by nozzle plate and/or printer skew with respect to the perpendicular direction of carrier travel.

19 Claims, 5 Drawing Sheets

METHOD AND SYSTEM FOR COMPENSATING FOR SKEW IN AN INK JET PRINTER

TECHNICAL FIELD

The present invention relates to ink jet printers and the like, and is particularly directed to a method and apparatus for compensation of nozzle plate skew with respect to the perpendicular direction of carrier travel.

BACKGROUND OF THE INVENTION

Ink jet printers have become extremely popular because of their relatively low cost and high output quality, which can rival that of a laser printer. Ink jet printers use a replaceable cartridge that contains a supply of ink, and a printhead through which the ink is emitted. The cartridge is attached to a carrier which reciprocates along a guide rod in a direction transverse to the direction of travel of the substrate. As the printhead passes over the substrate, such as a sheet of paper, ink drops are emitted through a nozzle plate onto the paper. The ink drops emitted on a single pass of the printhead are referred to as a "swath". While ink jet printers are superior to laser printers in some respects, ink jet printers are typically slower printing devices than laser printers. One method used to enhance printing speed is to increase the size of the nozzle plate in order to reduce printhead traversals of the paper. Unfortunately, an increase in nozzle plate size increases the potential for visually perceptible "stitching" errors. Stitching manifests itself in printed output as skewed vertical lines, blurry text, or through banding and hue shifts. Stitching occurs because of misalignment, or skew, of the nozzle plate with respect to the perpendicular direction of carrier travel, due to, for example, the common stack-up of mechanical tolerances in the various components of an ink jet printer, misalignment of the carrier guide rod with respect to the direction of paper travel, mechanical tolerances of the print nozzle itself, and the inherent difficulty of maintaining a precise alignment of a replaceable cartridge with respect to the carrier. Although stitching is not uncommon, stitching is frequently small enough that it is not perceptible to the human eye when relatively small nozzle plates are used however, as the size of the nozzle plate increases the amount of skew, or stitching, can become great enough to be perceptible to the human eye, especially at the inter-swath boundary.

Given the extremely fine adjustments which would be necessary, mechanical realignment of the nozzle plate with respect to the perpendicular direction of carrier travel by the consumer is impractical. Moreover, because the ink jet cartridge is replaced when the ink supply is exhausted, the amount of stitching can vary from printhead to printhead. Currently, consumers either accept the slight degradation in output caused by such skew, or return the printer to the manufacturer. Neither option is desirable from either the standpoint of the consumer or the manufacturer. Accordingly, it would be beneficial if such skew could be reduced, or eliminated, without requiring mechanical adjustment of the printer. It would also be desirable if such adjustment could be easily made each time a new printhead is installed in the printer.

SUMMARY OF THE INVENTION

It is one object of the present invention to provide a method and system for compensating for skew of a printhead nozzle plate with respect to a perpendicular direction of carrier travel without the need for mechanical adjustment of the printer.

It is another object of the present invention to provide a method and system for reducing swath skew with respect to an ideal swath location on a substrate through manipulation of the swath data.

It is still another object of the present invention to provide a method and system for reducing swath skew with respect to a perpendicular direction of carrier travel through modifying a default fire order sequence of a fire group on a nozzle plate.

Additional objects, advantages, and other novel features of the invention will be set forth in part in the description that follows and, in part, will become apparent to those skilled in the art upon examination of the invention. To achieve the foregoing and other objects and in accordance with the purposes of the present invention as described above, a method and system is provided for compensating for skew of a nozzle plate with respect to a perpendicular direction of carrier travel. The method includes receiving feedback regarding swath skew of ink drops generated by a printhead having at least one fire group, the fire group containing a plurality of nozzles. The amount of swath skew can be determined through interaction with a user of the printer, or through skew information generated during post-manufacture testing of printer components. A stream of swath data operative to direct the placement of ink drops by the printhead on a substrate is generated. If the amount of swath skew is greater than a predetermined value, the swath data is modified to create a gross skew adjustment, and a fire order sequence of the plurality of nozzles can be modified to create a fine skew adjustment.

The method and system according to this invention preferably work in a two phase process. Typically, the first phase is initiated upon installation of a new printhead cartridge in the printer, and the amount of swath skew with respect to an ideal swath location on the substrate is determined. A combination of gross skew adjustment, involving shifting of the swath data associated with certain nozzles, and fine skew adjustment, involving modifying a default fire order sequence of the nozzles in certain fire groups, is determined. The gross skew adjustments are applied on a nozzle-by-nozzle basis, and are stored in a persistent memory. The fire order sequence of fire groups is also stored in a persistent memory.

In the second phase, as swath data associated with a print request is generated, the gross skew adjustments are read from memory and applied to the swath data on a nozzle-by-nozzle basis. A controller on the printhead, based on the fine skew adjustments stored in the persistent memory, fires each fire group in its proper fire order sequence.

The gross skew adjustment causes shifts in ink drop placement a distance of one or more pels by modifying, or shifting, the actual swath data. Such an adjustment places individual ink drops within a pel distance from their ideal location. The fine skew adjustment shifts ink drop placement a distance of a fraction of a pel by prematurely initiating or delaying the firing of the nozzles by altering the default fire order sequence of the respective fire group. The application of gross and fine skew adjustments reduces the swath skew to an amount imperceptible to the human eye.

Still other objects of the present invention will become apparent to those skilled in this art from the following description, wherein there is shown and described preferred embodiments of this invention. As will be realized, the invention is capable of other different obvious aspects all without departing from the invention. Accordingly, the drawings and description will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to present preferred embodiments of the invention, examples of which are illustrated in the accompanying drawings, wherein like numerals indicate the same elements throughout the views.

DETAILED DESCRIPTION OF PREFERRED EMBODIMENTS

Figure 1:
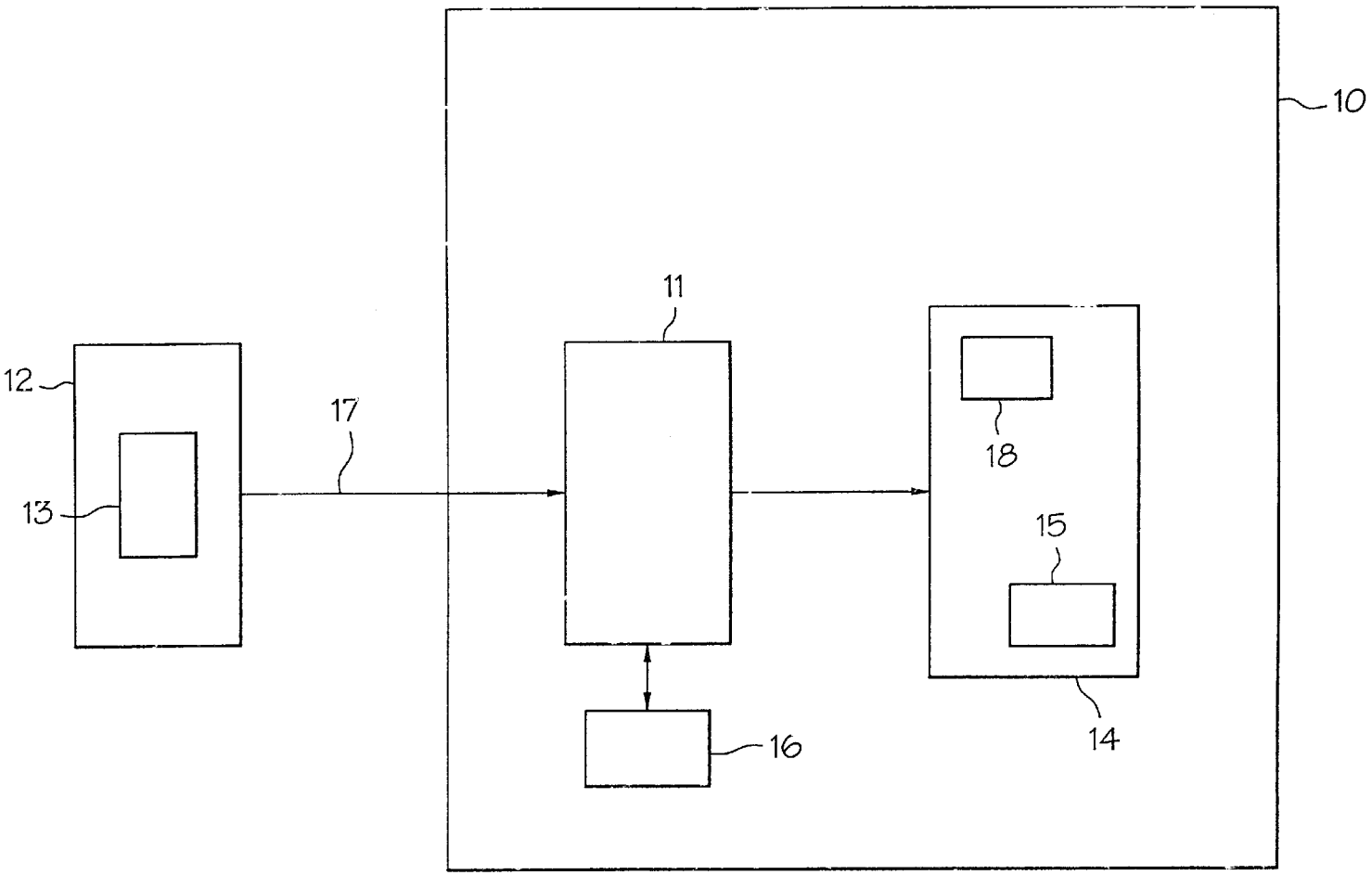
FIG. 1 is a block diagram illustrating components of the system according to one embodiment of this invention.

Referring now to the drawings, FIG. 1 is a block diagram showing components in a printer 10 useful in implementing the system of the present invention. A print driver 13 executing on a computer 12 generates data defining an image to be printed. Computer 12 communicates the data over a channel 17 to the printer 10. Channel 17 is a data communications path, such as an internal bus, a serial or parallel port, or local area network. An Application Specific Integrated Circuit (ASIC) 11 receives the data, and drives a print cartridge 14. Print cartridge 14 contains a supply of ink, and a printhead that carries a nozzle plate, through which ink drops are emitted onto a substrate. After the supply of ink in print cartridge 14 has been exhausted, a user replaces the cartridge 14 with a new cartridge 14 having a new supply of ink and a new nozzle plate. Print cartridge 14 is replaceably mounted in a carrier that reciprocates on a guide rod in a transverse direction to the direction of paper travel. The ink drops printed in each respective pass of the nozzle plate across the substrate is referred to herein as a swath. The data which controls the placement of ink drops is referred to as swath data.

Print cartridge 14 can include a memory 15 suitable for storing parameters associated with the printhead. As discussed in greater detail herein, memory 15 can be used to store fine skew adjustment information associated with each fire group on print cartridge 14. Print cartridge 14 includes a chip 18 that controls the functioning of print cartridge 14, and dictates the fire order sequence of the fire groups. Printer 10 also preferably includes a memory 16 in which other parameters, such as gross skew adjustments, as described in greater detail herein, can be stored. Portions of the method and system according to this invention, such as the swath data adjustments discussed herein, can be implemented in ASIC 11, or as program code segments that can be executed by a microprocessor.

Figure 2:
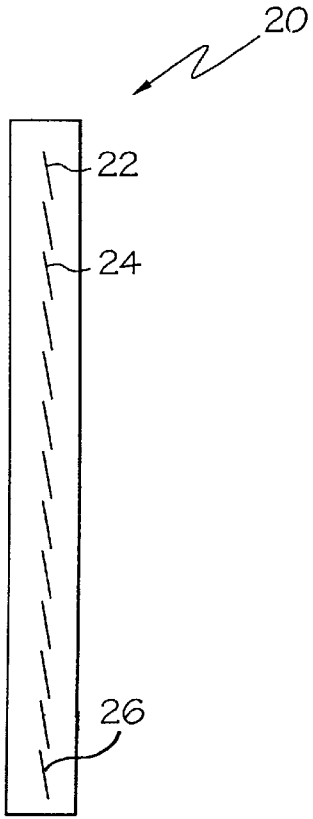
FIG. 2 is a diagrammatic view of a printhead showing a plurality of fire groups.

FIG. 2 is a diagrammatic view of a nozzle plate 20 containing a plurality of fire groups, such as fire groups 22, 24 and 26. To increase the page per minute output speed of an ink jet printer, the dimension of nozzle plate 20 that is perpendicular to the direction of carrier travel can be increased. The larger such dimension of nozzle plate 20, the fewer traversals of nozzle plate 20 across a piece of paper are necessary to print the page. While increasing such dimension of nozzle plate 20 will reduce printing time by reducing the number of carrier traversals necessary to print the page, it will also magnify any skew of nozzle plate 20 with respect to the perpendicular direction of carrier travel. Such skew can be caused, for example, by misalignment of the guide rod with respect to the perpendicular direction of substrate travel, failure to meet manufacturing specifications of the cartridge and/or nozzle plate 20, or the difficulty in maintaining perfect alignment between the replaceable cartridge which carries nozzle plate 20 and the carrier in which the cartridge is inserted.

There are a plurality of nozzles associated with each fire group 22, 24 and 26. The large quantity of swath data necessary to drive a high-resolution nozzle plate precludes simultaneous firing of each nozzle on nozzle plate 20. Instead, one nozzle from each fire group can be fired simultaneously. Nozzles within a fire group are typically fired in a sequential, predetermined order. Because the carrier moves at a constant velocity in a direction transverse to the direction of paper travel, the nozzles within a fire group are spaced a distance from each other in the direction of carrier travel, as shown more clearly in FIG. 3.

Figure 3:
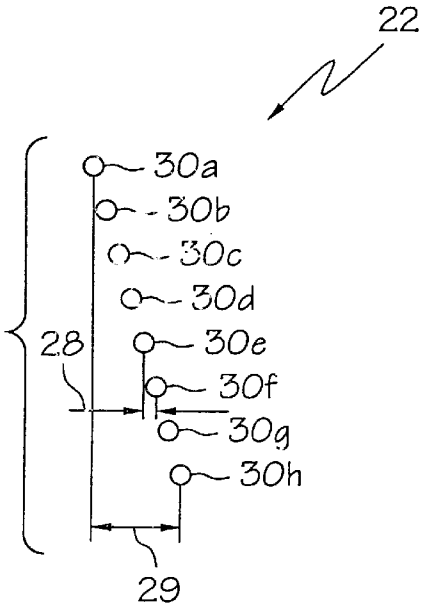
FIG. 3 is a diagrammatic view of a plurality of nozzles associated with a single fire group shown in FIG. 2.

FIG. 3 is a diagrammatic view of the plurality of nozzles associated with a particular fire group, such as fire group 22. Assuming carrier travel direction from left to right, a typical default fire order sequence of fire group 22 would be nozzle 30*h*, 30*g*, 30*f* and 30*e* through 30*a*, respectively. Although two nozzles within the same fire group are not fired simultaneously, nozzles from different fire groups can be fired simultaneously.

For example, nozzle 30*h* of fire group 22 can be fired simultaneously with a nozzle in fire group 26 (shown in FIG. 2). As the next nozzle in the fire order sequence (nozzle 30*g*) fires, it will ideally be in the same vertical plane as the ink drop previously emitted from nozzle 30*h* because of the continuous travel of the carrier. The distance illustrated by arrow 28 reflects the distance, in the carrier travel direction, between each nozzle on the nozzle plate, and is referred to as the inter-nozzle distance. While this distance can differ depending on the design of the nozzle plate, for the purposes of illustrating the present invention, it will be assumed that this distance is ⅛ (0.125) of a pel (pixel). The distance illustrated by arrow 29 reflects the distance, in the carrier travel direction, between the first and last nozzles of the fire group, and is referred to as the cumulative inter-nozzle distance across the fire group. While this distance can also differ depending on the design of the nozzle plate, for the purposes of illustrating the present invention, it will be assumed that this distance is ⅞ (0.875) of a pel.

It should be readily apparent that even slight skewing of nozzle plate 20 with respect to the perpendicular direction of carrier travel, whether caused by guide rod skew, printhead manufacturing problems, or the like, can result in "stitching" errors. Such stitching errors can be great enough to be visually perceptible, especially with regard to vertical lines at the inter-swath boundary. Such stitching, or swath skew, can also manifest itself in banding and hue shifts, degrading clarity and color.

Figure 4:
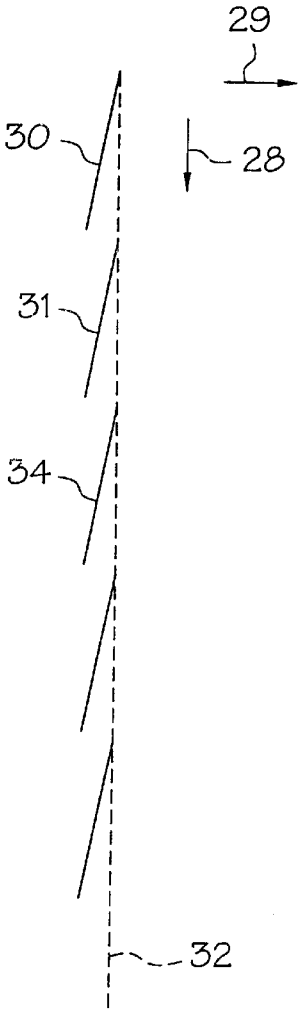
FIG. 4 is an enlarged plan view illustrating stitching errors, or skew, of swaths of ink drops with respect to an ideal ink drop placement on a substrate.

FIG. 4 is a diagrammatic view showing stitching errors caused by swath skew with respect to the perpendicular direction of carrier travel. Each of swaths 30, 31, and 34 reflect a single pass of nozzle plate 20. Arrow 29 shows the direction of carrier travel, and arrow 28 indicates the direction of substrate travel. While the invention herein will be discussed with regard to the travel of the printhead in a single direction, such as that reflected by arrow 29, in fact, nozzle plate 20 typically prints in each direction as it reciprocates along the guide rod, each direction ideally being perpendicular to the direction of substrate travel. Line 32 represents an ideal vertical line which would be printed in the absence of swath skew. While the invention herein will be specifically described with respect to the skewing of vertical lines for ease of illustration, it will be appreciated that swath skew affects all printer output, resulting in such visually perceptible errors as blurry text and images, and banding and hue shifts. It should be noted that it is not uncommon for stitching errors to occur to some extent in any ink jet printer. As long as the stitching error is below about 10.7 $\mu$m the error will not be visible to the human eye.

Therefore, the present invention can be used to reduce stitching error to below about 10.7 $\mu$m. As shown in FIG. 4, stitching error is typically most apparent at the inter-swath boundaries.

Figure 5:
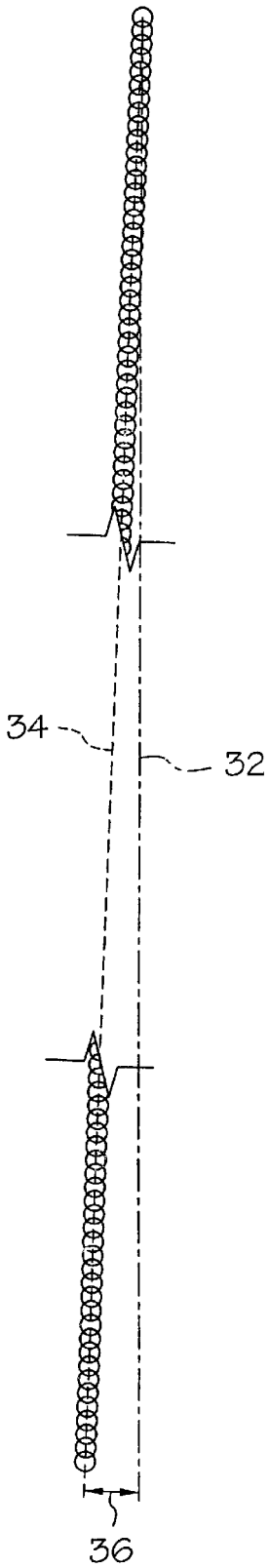
FIG. 5 is a diagrammatic view of an uncorrected single swath of ink drops shown in FIG. 4.

FIG. 5 is a diagrammatic view of the swath 34 shown in FIG. 4. It is relevant to note the extremely fine scale to which the diagrams shown herein relate. For example, it is unlikely that the distance illustrated by arrow 36 would be much greater than about 42 microns. For illustrative purposes, FIG. 5 shows the distance to be about 150 microns. The diameter of a single pel will differ depending on the resolution of the printer, but, for example, assuming a 600 dot per inch (DPI) printer, the spacing of a pel is approximately 42.3 $\mu$m. Nevertheless, swath skew of a distance of less than one pel can be perceptible to the human eye, resulting in jagged or blurred ink jet output. FIG. 5 also illustrates that individual ink drops typically overlap one another.

The method and system according to one embodiment of this invention determines the amount of swath skew on the substrate with respect to ideal line 32. The amount of swath skew can be determined through feedback from a user of the printer in a process which is initiated after the insertion of a new nozzle plate 20 in the carrier. For example, the printer can print a plurality of lines on a piece of paper, and the user can specify via buttons on a printer panel which line appears clearest. According to another embodiment of this invention, the swath skew associated with each printhead is measured during the manufacturing process and stored in a memory residing on the printhead, such as memory 15 (FIG. 1). Similarly, the skew associated with each printer can be measured in the factory and stored in a memory on the printer, such as memory 16 (FIG. 1). After the printhead is installed, the information from memory 16 and memory 15 can be combined to determine the composite skew of the printhead and the printer.

The present invention compensates for printer and/or printhead skew such that the resulting swath skew on the substrate is imperceptible to the human eye. In general, this is accomplished by applying, as needed, 'gross' and 'fine' skew adjustments. The gross skew adjustment includes manipulation of the swath data, and is used to shift ink drop placement by a distance of one or more pels. The gross skew adjustment is applied on a nozzle-by-nozzle basis. The fine skew adjustment involves, on a fire group by fire group basis, altering the default fire order sequence of one or more of the fire groups of nozzle plate 20. As discussed in greater detail herein, the modification of the fire order sequence can result in fine, intra-pel distance shifts in ink drop placement. While some swath skew may still exist after application of the present invention, the gross and fine skew adjustments will preferably render the skew imperceptible.

The gross and fine skew adjustments are determined upon insertion, or first use, of a new print cartridge 14. The gross skew adjustments, on a nozzle-by-nozzle basis, can be stored in a static memory on a storage device, or in a memory associated with the printer, such as memory 16. The fine skew adjustments are made on a fire group by fire group basis, and typically can be defined by indicating which of the nozzles of the respective fire group should be fired first. Thus, for each fire group, a value is stored in a static memory indicating which nozzle is the first nozzle in the fire order sequence. Since nozzles are fired in a round-robin fashion, only an initial firing nozzle need be recorded to identify the proper fire order sequence of that particular fire group. An application specific integrated circuit (ASIC) typically drives nozzle plate 20. The fire order sequence for each fire group can be stored in memory 15 (FIG. 1), and read by chip 18, which can then initiate the proper fire order sequence for each fire group. The gross skew adjustment can be applied to the swath data either at the printer driver level, executing on the computer from which the image was initially created, or within the ink jet printer itself, such as in the firmware of the ink jet printer.

Figure 6:
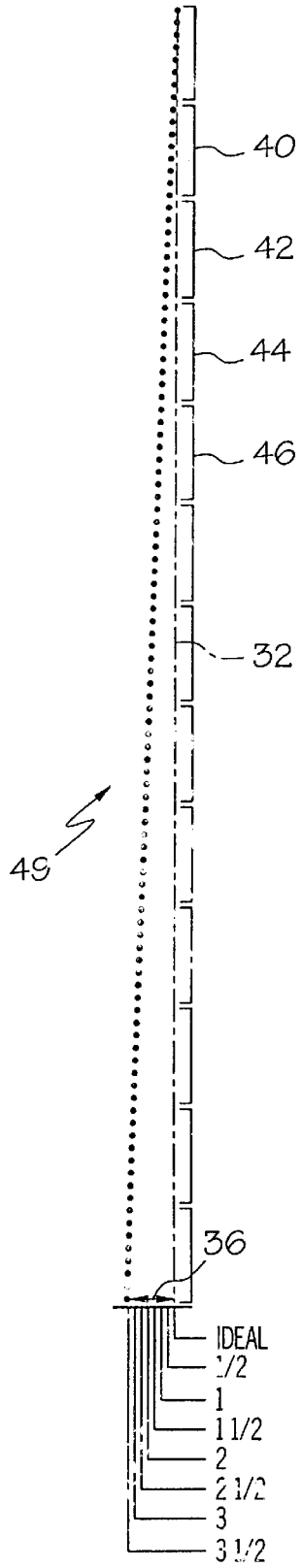
FIG. 6 is a diagrammatic view showing ink drop centers which form the swath shown in FIG. 5.

FIG. 6 is a diagrammatic view of ink drops which create line 34 shown in FIG. 5. For purposes of illustration, the center of the ink drops are represented in FIGS. 6–9, and the overlapping portions of the ink drops will not be shown. As shown in FIG. 6, line segment 49 contains a plurality of ink drops (a swath) skewed with respect to ideal line 32. At the bottom of line segment 49, the distance between the ink drops and ideal line 32 is shown. Although it is unlikely that swath skew would be greater than about one pel, for purposes of illustration, FIG. 6 shows an overall skew of 3.5 pels. Brackets, such as brackets 40, 42, 44, and 46 illustrate the ink drops associated with a particular fire group.

Figure 7:
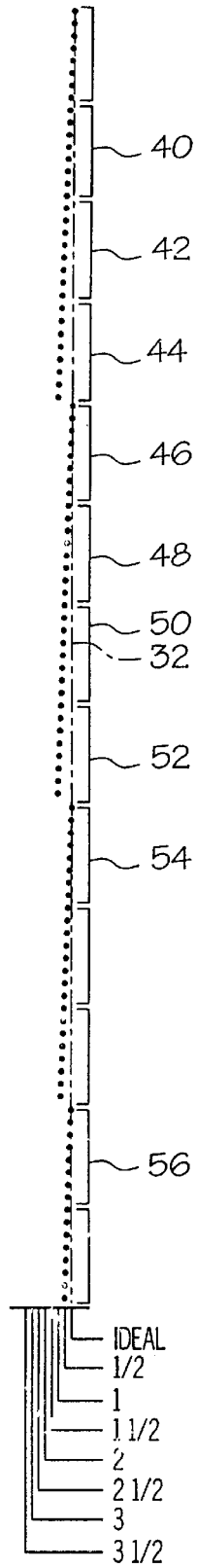
FIG. 7 is a diagrammatic view showing the effect of an initial swath data adjustment of the swath shown in FIG. 6.
Figure 8:
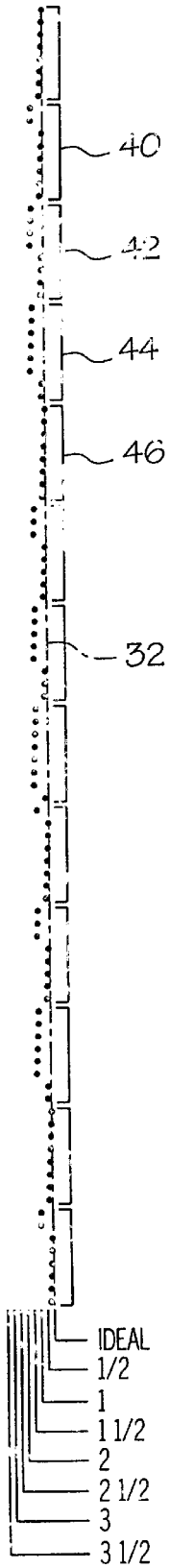
FIG. 8 is a diagrammatic view illustrating the preliminary effect of a fire order adjustment to the swath shown in FIG. 7 according to one embodiment of this invention.
Figure 9:
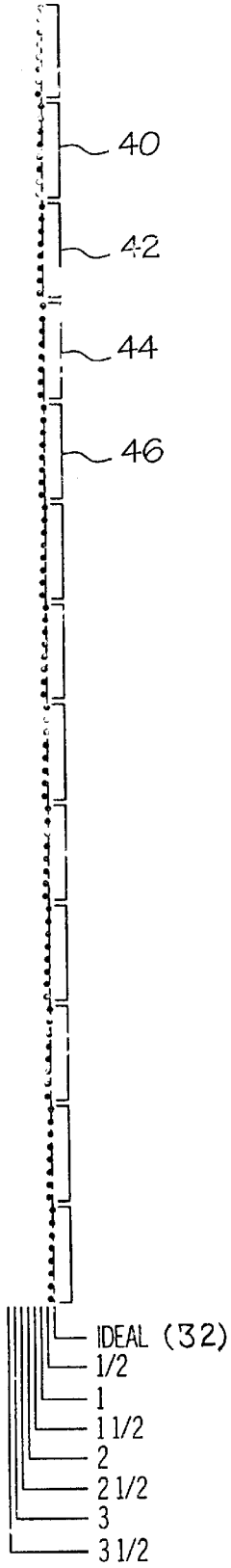
FIG. 9 is a diagrammatic view illustrating the overall effect of swath data and fire order adjustments to the swath shown in FIG. 7.

FIGS. 7, 8 and 9 will be discussed herein to illustrate the process according to one embodiment of the present invention for applying gross and fine skew adjustments to reduce the swath skew shown in FIG. 6 such that the skew is imperceptible to the human eye. FIGS. 7 and 8 illustrate particular components of such adjustments, and represent intermediate steps in the process according to this invention. FIG. 9 illustrates how the actual swath will appear on the substrate after application of the gross and fine skew adjustments according to the present invention.

Referring now to FIG. 7, it is illustrated how the adjustment of swath data (a 'gross skew' adjustment) can be used to bring ink drops in the swath within one pel distance of their ideal location. Such swath data adjustments occur by shifting the swath data in pel increments. For example, swath data for fire groups 46, 48, 50, and 52 have each been shifted one pel to the right, resulting in the ink drops associated with each of those fire groups being shifted one pel closer to ideal line 32 (compared to their location with respect to FIG. 6). Similarly, the swath data associated with fire group 54 has been shifted a distance of two pels, bringing the ink drops associated with fire group 54 closer to ideal line 32 (compared to their location with respect to FIG. 6). As a comparison of FIG. 7 to FIG. 6 illustrates, this gross skew adjustment reduces the overall swath skew to a certain extent. However, the gross skew adjustment represented in FIG. 7 still results in a swath that contains some 'jaggedness' that is perceptible to the human eye, and thus by itself will still result in blurry text, and/or band or hue shifts.

Prior to a discussion of the 'fine' skew adjustment according to the present invention, it will be helpful to discuss the process by which ink drops are typically emitted from a fire group. Referring again to FIG. 3, the nozzles in a fire group are placed a particular distance in a carrier travel direction from each other, the cumulative inter-nozzle distance across the fire group (distance 29) typically being less than one pel. For example, distance 29 between nozzle 30*a* and nozzle 30*h* is ⅞ of a pel. Moreover, the 'inter-nozzle' distance (distance 28) in a carrier travel direction, between each adjacent nozzle is ⅛ or 0.125 of a pel. The algorithm according to the present invention can apply a fine skew adjustment to shift a number of ink drops emitted by a fire group an intra-pel distance. Preferably, as discussed above, the nozzles in a fire group fire in a particular round-robin sequence, such that upon firing a particular nozzle first, each nozzle of the fire group will then subsequently fire in a sequential order. By default, assuming a carrier travel direction from left to right, the nozzle fire order would be 30*h*, 30*g*, 30*f*, 30*e*, 30*d*, 30*c*, 30*b*, and 30*a*. However, the default fire order can be changed, which will essentially either delay or prematurely fire a particular nozzle with respect to its default fire order. For example, assuming a carrier travel direction from left to right, if nozzle 30*e* were fired first, the fire order sequence would be nozzles 30*e*, 30*d*, 30*c*, 30*b*, 30*a*, 30*h*, 30*g*, and 30*f*.

Such deviation from the default fire order sequence will shift the placement of ink drops an intra-pel distance from what would have been their default location. For example, if nozzle 30*a*, rather than nozzle 30*h*, is fired first, followed by the firing of nozzles 30*h* through 30*b*, the ink drop emitted through nozzle 30*a* will be placed 0.875 pel prior to its default location, and the ink drops emitted from nozzles 30*h* through 30*b* will be shifted 0.125 pel past, or assuming carrier travel direction from left to right, to the right of their default location. The amount of ink drop shift is proportional to the deviation from the default fire order, and the distance between nozzles (inter-nozzle distance) in the carrier travel direction. For each nozzle prematurely fired, its distance from the default location can be calculated by the following formula:

(cumulative inter-nozzle distance across fire group (distance 29 of FIG. 3))−((#of nozzles prematurely fired-1)*(inter-nozzle distance (distance 28 of FIG. 3)).

Assuming nozzle 30*a* is fired first, the ink drop emitted from nozzle 30*a* would therefor be placed 0.875 pel prior to its default location. (0.875−((1−1)*0.125)=0.875 pel.) If nozzle 30*b* were fired first, then the ink drops emitted from both nozzles 30*a* and 30*b* would be placed 0.750 pel prior to their default location. (0.875−((2−1)*0.125)=0.750 pel.) Note that if certain nozzles are fired prematurely, other nozzles are fired late with respect to their default fire order. For example, if nozzle 30*a* is fired first, nozzles 30*h* through 30*b* are fired later than they would have with respect to their default fire order. Late firing of nozzles causes the ink drops emitted through such nozzles to be shifted past their default location. The location of ink drops emitted through later firing nozzles with respect to their default location can be calculated as follows:

(# of nozzles prematurely fired*inter-nozzle distance (distance 28 of FIG. 3)).

For example, if nozzle 30*a* is fired first, the ink drops emitted from nozzles 30*h* through 30*b* will be shifted 0.125 pel past their default location. (1*0.125 pel=0.125 pel.) If nozzle 30*b* is fired first, nozzles 30*h* through 30*c* will be shifted 0.250 pel past their default location. (2*0.125 pel=0.250 pel.) Thus, changing the default fire order sequence of a fire group alters the placement of ink drops by an intra-pel (fraction of a pel) distance.

Referring now to FIG. 8, a diagram is shown representing how altering the default fire order of fire groups would, by itself, affect the placement of ink drops. For example, looking at fire group 42, it is apparent that the bottom four ink drops associated with fire group 42 are located closer to ideal line 32 than they were in FIG. 7, while the upper four ink drops associated with fire group 42 are located farther away from ideal line 32 than they were in FIG. 7. This is because altering the fire order of fire group 42 shifted certain ink drops farther to the right than what would have occurred under the original default fire order, and caused other ink drops (the upper four) to shift farther to the left than what would have occurred under the original default fire order. This is shown also with respect to fire group 44, which shows that the bottom two ink drops are now closer to ideal line 32 than shown in FIG. 7, while the upper six ink drops are farther to the left of ideal line 32 than in FIG. 7. As will be discussed in greater detail herein, the ink drops that would be shifted farther to the left are brought back toward ideal line 32 through a swath data adjustment.

The net result of the fine skew adjustment resulting from changing the default fire order of the fire groups in conjunction with the gross skew adjustment of shifting the swath data is shown in FIG. 9. As can be seen, the overall effect is that each ink drop is sufficiently close to ideal line 32 that the skew has now been eliminated to the extent that it is imperceptible to the human eye.

Figure 10:
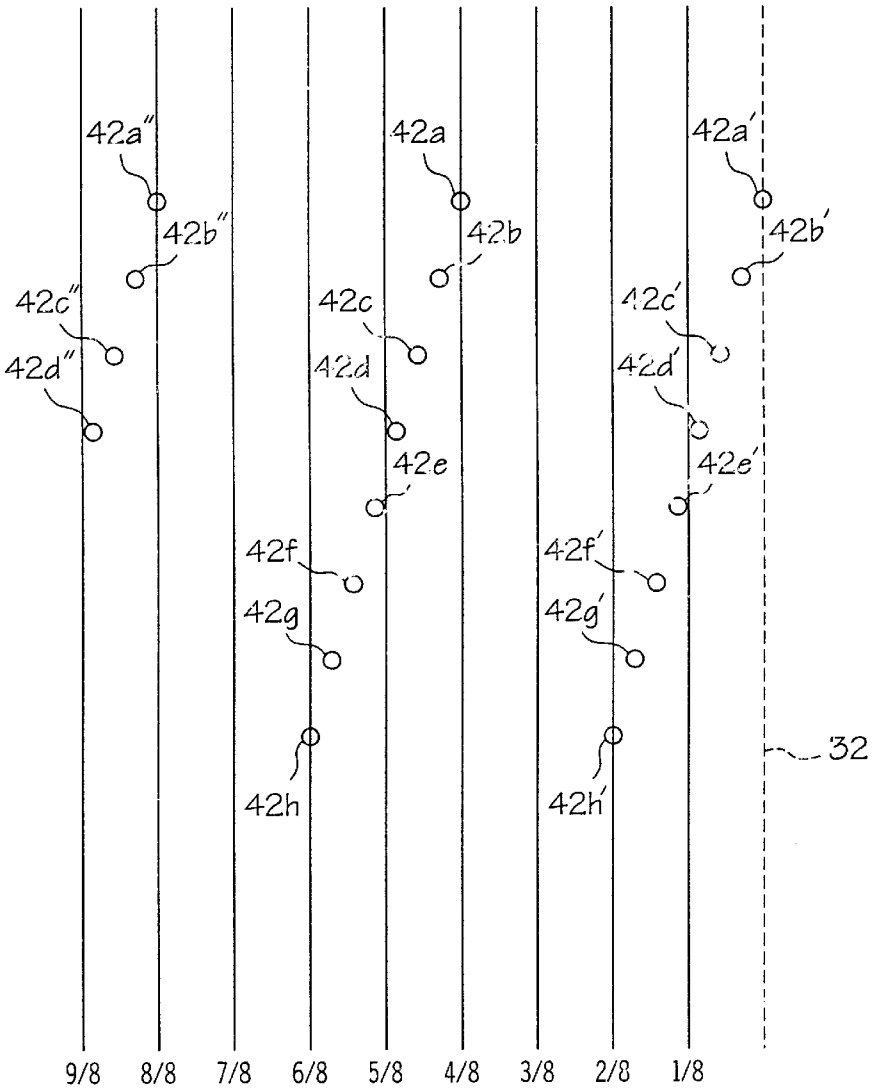
FIG. 10 is a diagrammatic view illustrating the adjustment of ink drop placement of ink drops associated with a single fire group through gross and fine skew adjustments according to one embodiment of the present invention.

The change in fire order sequence in conjunction with swath data adjustments can be described in greater detail with reference to FIG. 10. Drops 42*a*–42*h* represent the location of the ink drops emitted from fire group 42 after an initial swath data ('gross') adjustment has been calculated, as illustrated initially in FIG. 7. As indicated previously, the ink drops illustrated represent the center of the ink drop. It should be noted that, for purposes of illustration, FIG. 10 is not drawn to scale. The vertical lines represent distances in ⅛ pel increments from ideal line 32. Thus, ink drop 42*a* (i.e. the center of ink drop 42*a*) is located approximately ⅝ of a pel from ideal line 32, and ink drop 42*h* is located approximately ⅝ of a pel from ideal line 32. This closely approximates the location of ink drops 42*a*–42*h* as initially shown in FIG. 6. Ink drops 42*a*' through 42*h*' represent the corrected ink drop locations after application of the swath data and fire order adjustments according to the present invention.

As shown in FIG. 10, ink drops 42*a* through 42*h* will be located closer to ideal line 32 if each ink drop can be shifted ⅝ pel closer to ideal line 32, as represented by ink drops 42*a*' through 42*h*'. As discussed previously, the nozzles in the exemplary fire group discussed herein are ⅛ pel distance in a carrier direction from one another (distance 28 of FIG. 3). Changing the fire order sequence will therefore cause ink drop shifts in increments that are divisible by ⅛ pel. For example, by firing nozzle 42*d* first instead of 42*h* (the default sequence) ink drops 42*d*", 42*c*", 42*b*", and 42*a*" would be prematurely emitted and would be located ⅝ of a pel to the left of their default location, as represented. Correspondingly, the emission of ink drops 42*h*', 42*g*', 42*f*, and 42*e*' would be delayed with respect to the default sequence and would be emitted ⅝ pel closer to ideal line 32, as illustrated. This adjustment, by itself, would result in ink drops being emitted at locations 42*a*" through 42*d*" and 42*e*" through 42*h*'. To bring ink drops 42*a*" through 42*d*" closer to ideal line 32, a second swath data adjustment is made by shifting the swath data associated with the nozzles that emit ink drops 42*a*–42*d* a distance of one pel. This swath data adjustment shifts ink drops 42*a*" through 42*d*" to locations 42*a*' through 42*d*', respectively. It is noted that the distance between ink drops 42*a*' and 42*a*" is exactly one pel. Similarly, the distance between each of ink drops 42*b*", 42*c*", 42*d*" and 42*b*', 42*c*', and 42*d*', respectively, is one pel. Thus, the overall effect of changing the default fire order sequence in conjunction with a swath data adjustment moves the ink drops closer to ideal line 32.

A method for determining the amount of swath data adjustment and proper fire group fire order sequence can now be described with reference to FIGS. 6–10. The following assumptions are made:

$E_{tss}$=Total swath skew (distance 36 of FIG. 6).

$N_n$=Number of nozzles on nozzle plate.

n=Ascending numeric representation of nozzle on nozzle plate.

$N_f$=Number of nozzles in fire group.

The variable $E_{tss}$ represents the total swath skew, as identified by element reference numeral 36 in FIG. 6, and can be determined in a number of ways, as discussed previously.

The variable $N_n$ represents the total number of nozzles on the nozzle plate, which for this example will be assumed to be one hundred and four (104) nozzles. The variable n represents the ascending numeric representation of any particular nozzle. For example, the very first nozzle on the nozzle plate would be zero while the last nozzle on the nozzle plate would be nozzle 103. The variable $N_f$ equals the total number of nozzles in a fire group, which for this example will be eight.

The calculation to determine the initial gross skew adjustment, represented in FIG. 7, can be made as follows:

$$X = \frac{\frac{n}{N_n * E_{tss}}}{\text{pel}}$$

Where the units of $E_{tss}$ are pels, the denominator, pel, is equal to 1. The value 'X' is then calculated for the first nozzle of each fire group. Table 1, represented below, shows in column three the X value associated with the first nozzle of each fire group.

TABLE 1

| Fire Group | First Nozzle | x | integer(x) | fraction(x) | $N_1$ | First Fire |
|---|---|---|---|---|---|---|
| 38 | 0 | 0.00 | 0 | 0.00 | 0 | H |
| 40 | 8 | 0.28 | 0 | 0.28 | 2 | B |
| 42 | 16 | 0.55 | 0 | 0.55 | 4 | D |
| 44 | 24 | 0.83 | 0 | 0.83 | 6 | F |
| 46 | 32 | 1.10 | 1 | 0.10 | 0 | H |

TABLE 1-continued

| Fire Group | First Nozzle | x | integer(x) | fraction(x) | $N_1$ | First Fire |
|---|---|---|---|---|---|---|
| 48 | 40 | 1.38 | 1 | 0.38 | 3 | C |
| 50 | 48 | 1.65 | 1 | 0.65 | 5 | E |
| 52 | 56 | 1.93 | 1 | 0.93 | 7 | G |
| 54 | 64 | 2.20 | 2 | 0.20 | 1 | A |
| 56 | 72 | 2.48 | 2 | 0.48 | 3 | C |
| 58 | 80 | 2.75 | 2 | 0.75 | 6 | F |
| 60 | 88 | 3.03 | 3 | 0.03 | 0 | H |
| 62 | 96 | 3.30 | 3 | 0.30 | 2 | B |

The integer portion of the X value, as shown in column four of Table 1, represents the number of pels to shift the swath data for any particular fire group. For example, for fire groups 38, 40, 42, and 44, the integer component is zero, representing that the swath data for those fire groups should be shifted zero pels. For fire groups 46, 48, 50, and 52, the integer component is 1, indicating that the swath data associated with each of these fire groups should be shifted one pet. After the swath data is shifted the number of pels indicated in column four, the ink drop location would be as illustrated in FIG. 7.

A formula for determining the fine skew adjustment as represented in FIG. 8 is as follows:

$$N_1 = \text{integer (fraction (x)}*N_F)$$

The calculated $N_1$ value is reflected in column six of Table 1. The calculated $N_1$ value is then applied to the table below to determine which nozzle for the respective fire group should be fired first.

TABLE 2

| Calculated nozzle, $N_1$ | 0 | 1 | 2 | 3 | 4 | 5 | 6 | 7 |
|---|---|---|---|---|---|---|---|---|
| first nozzle to fire | H | A | B | C | D | E | F | G |

For example, the row associated with fire group 42 in Table 1 contains a value of four under column six ("$N_1$"). Using the number four and applying it to Table 2 above, it can be seen that nozzle D of fire group 42 should be fired first. As shown and discussed previously with regard to FIG. 10, firing nozzle D first results in a shift of ink drops 42*e*', 42*f*', 42*g*', 42*h*' to the right a distance of ⅝ of a pel from their default location, bringing these four ink drops closer to ideal line 32. The second phase of the fine skew adjustment involves a swath data adjustment of one pel for each nozzle equal to or lower in the alphabet than the first fired nozzle. For example, with respect to fire group 42, nozzle 42*d* was first fired, so the swath data associated with nozzles 42*d*, 42*c*, 42*b*, and 42*a* are each shifted a distance of one pel. The overall effect of the swath data adjustment and fire order adjustment is reflected in FIG. 9, which illustrates net effect of the adjustments, Although the swath shown in FIG. 9 contains some slight deviation from ideal line 32, it is close enough to ideal line 32 that the human eye cannot perceive any skew. Although the gross skew adjustment has been discussed as two separate steps, only one cumulative swath data adjustment number need be maintained for any given nozzle.

The foregoing description of preferred embodiments of the invention has been presented for purposes of illustration and description. It not intended to be exhaustive or to limit the invention to the precise form disclosed. Obvious modifications or variations are possible in light of the above teachings. For example, the nozzle pattern of the fire groups illustrated throughout this application was presented for simplicity and to clarify the description of the invention. It is apparent that various manufacturers of printheads use different nozzle patterns than that reflected in the present application. However, the application of the invention will work with any nozzle pattern. The embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A method for compensating for swath skew with respect to a perpendicular direction of carrier travel in a printer, comprising;

providing a printhead having at least one firing group, the at least one firing group having a plurality of nozzles for placing ink drops on a substrate;

supplying, swath data to said printhead to control a placement of said ink drops on said substrate;

determining an amount of swath skew of said ink drops placed on said substrate; and modifying a fire order sequence of the plurality of nozzles of said at least one firing group to shift an ink drop placement a distance of less than one pel.

2. A method according to claim 1, further comprising the step of modifying at least a portion of the swath data to shift the portion of the swath data by a distance of more than one pel.

3. A method according to claim 2, wherein the modified portion of the swath data comprises swath data that is associated with only one of the plurality of nozzles.

4. A method according to claim 2, wherein said at least one firing group comprises a first firing group and a second firing group, each of the first and second firing groups having a plurality of nozzles, and wherein the swath data is adjusted for only one of the plurality of nozzles of the first firing group, and the swath data is adjusted for at least two of the plurality of nozzles of the second firing group.

5. A method according to claim 4, wherein a fire order sequence of the plurality of nozzles of the first fire group is different from a fire order sequence of the plurality of nozzles of the second fire group.

6. A method according to claim 1, wherein the modifying a fire order sequence step comprises determining which of the plurality of nozzles to fire first, and storing a value in a memory associated with the printhead indicating a first nozzle to fire.

7. A method according to claim 1, wherein the receiving and determining steps are performed upon first use of a printhead after insertion of the printhead into a carrier, and the generating a stream of swath data and modifying at least a portion of the swath data steps are performed for each image to be output.

8. A system for adjusting for swath skew of ink drops with respect to an ideal ink drop placement on a substrate, comprising:

a printhead having a first fire group, the first fire group having a plurality of nozzles, the plurality of nozzles having a fire order sequence;

a skew feedback mechanism operative to determine an extent of swath skew of ink drops with respect to an ideal ink drop placement on a substrate;

a gross skew adjustment mechanism in communication with the skew feedback mechanism being operative to modify swath data being communicated to the printhead; and a fine skew adjustment mechanism in communication with the skew feedback mechanism being operative to set the fire order sequence of the plurality of nozzles.

9. A system according to claim 8, wherein the gross skew adjustment mechanism modifies swath data by shifting ink drop placement associated with at least one nozzle a distance of one pel.

10. A system according to claim 8, further comprising a memory associated with the printhead, and wherein the fine skew adjustment mechanism is operative to store in the memory a value indicating the fire order sequence of the plurality of nozzles.

11. A system according to claim 8, wherein the printhead further comprises a plurality of fire groups, the fine skew adjustment mechanism being operative to store a value in a memory associated with the printhead indicating a fire order sequence of the plurality of nozzles associated with each respective fire group.

12. A system according to claim 8, wherein the printhead further comprises a second fire group having a plurality of nozzles, and wherein the gross skew mechanism is operative to modify the swath data associated with only one of the plurality of nozzles associated with the first fire group and is operative to modify the swath data associated with at least two of the plurality of nozzles associated with the second fire group.

13. A system according to claim 8, wherein the printhead further comprises a second fire group having a plurality of nozzles, and wherein the fine skew adjustment mechanism is operative to set the fire order sequence of the plurality of nozzles on the second fire group to a different fire order sequence than the fire order sequence of the plurality of nozzles on the first fire group.

14. A system according to claim 8, wherein the skew feedback mechanism comprises a memory containing a premeasured value indicative of an amount of skew associated with the printhead.

15. A method for reducing swath skew in a printer, comprising:

determining an amount of swath skew with respect to an ideal swath placement by a printhead having a fire group, the fire group having a plurality of nozzles;

modifying by a predetermined pel width increment a portion of a stream of swath data indicating ink drop location;

identifying which of the plurality of nozzles to fire first in a nozzle firing sequence to create a fine ink drop placement adjustment; and firing the plurality of nozzles by firing first the identified nozzle.

16. A method according to claim 15, further comprising storing in a memory the identity of the nozzle to fire first.

17. A method according to claim 15, wherein each nozzle is a predetermined distance in a direction of carrier travel from an adjacent nozzle, and wherein the location of ink drop placement is shifted in units of the predetermined distance by altering the fire order sequence of the plurality of nozzles.

18. A method according to claim 15, wherein the portion of the stream of swath data comprises the swath data associated with only one of the plurality of nozzles.

19. A method according to claim 15, wherein the printhead comprises a plurality of fire groups, each fire group having a plurality of respective nozzles, and further comprising applying the modifying step and identifying step to each of the fire groups to locate ink drops emanating from such nozzles.

* * * * *

UNITED STATES PATENT AND TRADEMARK OFFICE

CERTIFICATE OF CORRECTION

PATENT NO. : 6,350,004 B1
DATED : February 26, 2002
INVENTOR(S) : Benjamin A. Askren It is certified that error appears in the above-identified patent and that said Letters Patent is hereby corrected as shown below:

Column 1,
Line 41, after "used" insert -- . --;
Line 42, change "however" to -- However --;

Column 9,
Lines 47-52, change " $X=\frac{N_n^{n} * E_{tss}}{pel}$ " to -- $X=\frac{N_n^{n} * E_{tss}}{pel}$ --;

Column 10,
Line 22, change "pet" to -- pel --;
Lines 28, 29 and 36, change "$N_1$" to -- $N_I$ --;

Signed and Sealed this

First Day of October, 2002

*Attest:*

*Attesting Officer*

JAMES E. ROGAN
*Director of the United States Patent and Trademark Office*